United States Patent [19]

Lahijani

[11] Patent Number: 4,990,285

[45] Date of Patent: Feb. 5, 1991

[54] BALANCED ULTRA-HIGH MODULUS AND HIGH TENSILE STRENGTH CARBON FIBERS

[75] Inventor: Jacob Lahijani, Wilmington, Del.

[73] Assignee: E. I. Du Pont de Nemours and Company, Wilmington, Del.

[21] Appl. No.: 439,055

[22] Filed: Nov. 20, 1989

Related U.S. Application Data

[62] Division of Ser. No. 158,677, Feb. 22, 1988, Pat. No. 4,915,926.

[51] Int. Cl.[5] ..... H01B 1/18

[52] U.S. Cl. ..... 252/502; 252/510; 423/447.1; 423/447.2; 423/447.4; 423/447.6; 423/448; 264/29.2; 264/29.7

[58] Field of Search ..... 423/447.1, 447.2, 447.4, 423/447.6, 447.8, 448; 264/29.2, 29.7; 208/45; 252/503, 510

[56] References Cited

U.S. PATENT DOCUMENTS

| | | | |
|---|---|---|---|
| 3,899,574 | 8/1975 | Siliva et al. | 423/447.1 |
| 4,016,247 | 4/1977 | Otani et al. | 423/448 |
| 4,529,498 | 7/1985 | Watanabe | 423/447.2 |
| 4,533,535 | 8/1985 | Uemura et al. | 423/447.2 |
| 4,628,001 | 12/1986 | Sasaki et al. | 423/447.4 |
| 4,664,900 | 5/1987 | Miyazaki et al. | 252/502 |
| 4,698,179 | 10/1987 | Suzuki et al. | 252/510 |
| 4,810,419 | 3/1989 | Kumimoto et al. | 252/502 |
| 4,849,200 | 7/1989 | Uemura et al. | 252/502 |

FOREIGN PATENT DOCUMENTS

| | | | |
|---|---|---|---|
| 62-41320 | 2/1987 | Japan | 423/447.6 |
| 2170491 | 8/1986 | United Kingdom | 423/447.1 |

*Primary Examiner*—Olik Chaudhuri
*Assistant Examiner*—Robert M. Kunemura

[57] ABSTRACT

Carbon fibers having balanced properties comprising an ultra-high modulus greater than 100 Mpsi and a high tensile strength of greater than 500 kpsi. The carbon fibers are derived from a solvent fractionated pitch having a mesophase content of greater than 90% by weight and a quinoline insolubles content of less than 1% by weight. A crude pitch feed is sequentially heat soaked, solvent fractionated, and extruded to form as-spun fibers. The latter are stabilized or infusibilized and then carbonized by multistage heat treatments involving separate precarbonization, carbonization, and graphitization steps with an intermediate cooling step.

3 Claims, No Drawings

BALANCED ULTRA-HIGH MODULUS AND HIGH TENSILE STRENGTH CARBON FIBERS

This application is a division of Ser. No. 158,677, filed Feb. 22, 1988, now U.S. Pat. No. 4,915,926.

BACKGROUND OF THE INVENTION

The present invention relates to a carbon fiber product having balanced ultra-high Young's modulus and high tensile strength properties. More particularly, the invention pertains to carbon fibers having a modulus of greater than 100 Mpsi and a tensile strength of at least 500 kpsi derived from a solvent fractionated, mesophase pitch having a low quinoline insolubles content. The invention is also concerned with the process for preparing such ultra-high modulus and high tensile strength pitch carbon fibers.

In recent years, technical literature and patents are replete with disclosures of carbon fibers prepared from polyacrylonitrile and carbonaceous pitch. Processes utilizing polyacrylonitrile and processes utilizing a pitch fraction, i.e. mesophase pitch, as precursors are in commercial production. The use of mesophase pitch as the feed material would have numerous advantages, since polyacrylonitrile (PAN) fibers require expensive and complicated procedures, including the handling of toxic gas by-products.

High Young's modulus is one of the essential characteristics of commercial carbon fibers, since high stiffness is an important consideration when the carbon fibers are employed in the reinforcement of polymer, metal, and other matrices to provide advanced technology composites. Consequently, there has been considerable research on methods for enhancing modulus. Leonard S. Singer summarized the state of the prior art in his article entitled "Carbon Fibers from Mesophase Pitch" published in Fuel, Vol. 60 (1981, Sept.) pp. 839–847.

While PAN based fibers provide high tensile strengths at low modulus (30 to 40 Mpsi), attaining high modulus PAN carbon fibers has proven difficult. For example, a 1986 review of current carbon fibers, reports the highest modulus PAN fiber has a tenacity of 355 kpsi at 71 Mpsi modulus. (J. D. H. Hughes, Carbon, Volume 24, page 551 (1986). It would be highly advantgageous to produce carbon fibers that have high tensile strengths, i.e., greater than 500 kpsi, as well as ultra-high modulus. Such balanced properties, i.e. an excellent combination of ultra-high modulus and high tensile strength, would be highly desirable for a variety of commercial applications.

Previous investigations to improve the Young's modulus of carbon fibers dreived from pitch have involved the use of heat treatment temperatures ranging from 1500° to 3000° C. Of course, graphitization increases at the higher temperatures.

Fischer and Ruland in the "The Influence of Graphitization on the Mechanical Properties of Carbon Fibers", Colloid and Polymer Sciences, vol. 250, No. 8, pp. 917 to 920 (1980) reported that graphitization has an unfavorable effect on the mechanical properties, including tensile strength, of carbon fibers. Ng et al. in "Extended Abstracts of the 16th Biennial Conference on Carbon" Am. Chem. Soc., pp. 515–516 (1983) stated that high modulus carbon fibers spun from mesophase pitch performed less satisfactorily than PAN-based fiber.

A 1986 paper by Guigon and Oberlin, Composites Science and Technology, 25 (1986) pp. 231–241 reveals that the Young's modulus of mesophase pitch based carbon fibers increases with the average degree of graphitization. However, page 240 reports that the tensile strength is always low. The graphitization of polyacrylonitrile fibers also affects adversely the tensile strength. Published British Pat. No. 2,170,491 (Pepper and Patton) discloses on page 1, lines 26–40, that the strength and modulus of these carbonized fibers increase rapidly up to about 1400° C. Beyond 1400° C., however, while the Young's modulus increases, tensile strength decreases, reportedly because the structure of the carbonized fibers becomes more representative of true graphite. As a result of these occurences, the British Patent says that commercial PAN fibers are usually offered in a corbonized form with low modulus and high strength or in graphitized form with high modulus and low strength.

On the other hand, Published European Application No. 0159315 by Nakatani et al. emphasizes the need to balance the modulus of elasticity and tensile strength properties of carbon fibers based on acrylonitrile-type polymers. The inventors accomplish this by subjecting the fibers to a complex cycle of flame-resisting treatments, which include the application of elongation and then a series of carbonization treatments that do not exceed 1600° C.

Recent investigations (e.g. U.S. Pat. No. 4,504,454—Riggs) to produce mesophase pitch-based carbon fibers with higher tensile strengths involve solvent fractionation treatment with the initial use of known organic solvents having a solubility parameter from 9.2 to 11 to separate insolubles, and then treating the solution with an organic solvent having a solubility parameter from 7.4 to 9.0 in order to recover insolubles that are convertible to the carbon fibers. Although increased tensile strengths were obtained, Young's moduli were substantially less than 100 Mpsi. The production of fibers with high modulus was not explored.

Another approach has been to employ special feed materials. One example is the synthetic compound described in U.S. Pat. No. 4,670,129 (Tate et al.). Another is to hydrogenate mixtures of coal tar or coal tar pitch and an aromatic oil, heat the hydrogenated product in the presence of a cracking catalyst, and there treat the soluble fraction of the resulting reaction product to form mesophase, as described in British Patent No. 2,129,825. These are expensive processes.

Considerable effort to improve mechanical properties of mesophase pitch based carbon fibers has involved modifying the shape of a conventional, circular cross-section spinneret so that it has an enlarged nozzle outlet and thereby produces a wavy cross-sectional fiber structure (Japanese published Patent Application No. 62-42320 Nakajima et al.—Kashima Oil). Earlier work employed spinnerets modified in such a manner that they give ellipsoidal or multilobal fibers with "leafy lamella" microstructure. Typical patents directed to such features are as follows:

Japanese Patent Application Publication No. 61-275426 Ohyabu et al. (Mitsui Coke KK) U.S. Pat. No. 4,628,001, Sasaki et al. (Teijin Limited)

European Patent Application Publication No. 0219964, Edie et al. (Clemson University)

Spinnerets described in these references have narrow slots and are difficult to manufacture and maintain.

In the March/April 1987 issue of the SAMPE Journal, pp. 27–31, David A. Schulz in "Advances in UHM Carbon Fibers: Production, Properties and Applications" concludes that the production of ultra-high modulus (UHM) carbon fibers from pitch is a complex process involving many operations and extreme conditions. According to the author, it is known that ultra-high modulus carbon fibers derived from mesophase pitch possess higher crystallinity and reach higher modulus levels than fibers made from other precursors. Table II of the article sets forth the properties of Amoco's UHM Thornel P-100 fibers. The grand average tensile strength was 356.4 kpsi and the grand average tensile modulus was 111 MPSi, as measured by strand testing. Thus, despite many years of experience, Amoco's process has not led to improved tensile strength via the earlier patent disclosures.

It would be desirable, therefore, to have carbon fibers which exhibit balanced high tensile strength and ultra-high modulus. Moreover, it would be highly desirable to have the ability to produce such carbon fibers while avoiding the problems, special equipment, and special or exotic pitches required by the prior art in the manufacture of ultra-high modulus carbon fibers.

SUMMARY OF THE INVENTION

In accordance with the present invention there are provided mesophase pitch-based carbon fibers characterized by an ultra-high Young's modulus of greater than 100 Mpsi, preferably greater than 110 and a balanced tensile strength of greater than 500 kpsi. The preferred carbon fibers of the invention have an essentially round or circular cross-section.

The pitch precursor is a high (≧90%) mesophase pitch fraction having a low quinoline insolubles content of less than about 1% , preferably less than 0.3% by weight, solvent fractionated from a crude pitch feed that has been preheated to a temperature of from about 350° to 450° C.

Next, the solvent fractionated, high mesophase pitch fraction is extruded through a spinneret having conventional round cross-sectional nozzles to provide a plurality of so-called green fibers or as-spun fibers.

These green fibers are stabilized, or infusibilized in an oxidative gas atmosphere, precarbonized at a temperature of 400°–1000° C., and then carbonized at a temperature of from about 1000° to 2000° C. Carbonized fibers are subsequently graphitized at a temperature of from inert 2500° to 3000° C. All but the stabilization step are carried out in inert atmospheres.

DETAILED DESCRIPTION OF THE INVENTION AND THE PREFERRED EMBODIMENT

It is known that a variety of pitches may be employed to furnish high mesophase fractions that are useful for the preparation of carbon fibers. Such pitches include petroleum pitches, coal tar pitches, natural asphalts, pitches obtained as a coproduct of naphtha cracking, middle distillate cracking, gas oil cracking, and fractions having high aromatic carbon content obtained from extraction processes such as furfural extraction. Petroleum processes which can produce suitable petroleum pitches include catalytic cracking thermal cracking, and visbreaking.

Since it is believed that all of the steips in preparation of carbon fibers including the heat treatment of the crude pitch feed to convert it into the mesophase fraction, the recovery of the mesophase fraction from the undesirable portion of the crude pitch feed, the spinning of the mesophase fraction into as-spun fibers, the stabilization or infusibilization of the as-spun fibers, and the heat treatments involved in converting the stabilized fibers into carbon or graphite fibers may have an influence on the ultimate properties of the carbon fiber product, the present invention utilizes certain specific sequential treatments that lead to carbon fibers of the invention characterized by an outstanding balance of tensile properties. Many of these treatments, although not necessarily in the sequence employed herein, are found in the patent or technical literature and, when possible, representative prior art disclosures will be noted.

HEAT TREATMENT

In order to increase the mesophase content in the precursor feed for forming carbon fibers, the raw pitch is heated in accordance with the procedure described and illustrated in U.S. Pat. No. 4,184,942 (Angier et al.). The disclosure in this patent starting on line 27, column 4, and ending on line 31, column 5 is incorporated herein by reference. The heating can take place in a reactor or autoclave at a temperature within the range of about 350° to 480° C. For most purposes, the heating will be carried out at ambient pressures, although reduced pressures also can be utilized. Preferred pressures are from 1 psi to 20 psi, while the time of heating may vary from 1 to 20 hours. However, and as set forth in U.S. Pat. No. 4,184,942, it is particularly preferred to terminate the heating of the pitch just short of the transformation of the pitch into spherules that are observable by polarized microscopy.

An inert stripping gas such as nitrogen and the like can be employed during the heat soaking step to assist in the removal of lower molecular weight and volatile substances from the pitch.

SOLVENT FRACTIONATION

The heat treated pitch product is pulverized, generally in an inert atmosphere, and fluxed with an organic solvent system to recover the mesophase fraction of the pitch. See U.S. Pat. Nos. 4,208,267 (Diefendorf et al.) as well as 4,184,942 (Angier et al.). As disclosed by Angier et al., the amount of solvent employed will be sufficient to give a solvent insoluble fraction capable of being converted to greater than 90% optically anisotropic material, which is eminently suitable as a carbon fiber precursor.

The particularly preferred solvent fractionation procedure employed in the practice of the present invention is disclosed and illustrated in U.S. Pat. No. 4,277,324 (Greenwood). According to this patent, the heat soaked pitch product is admixed with a non-reactive, organic fluxing liquid; which, when mixed with pitch in sufficient amounts, will render the pitch sufficiently fluid so that it can be easily handled and which causes substantially all of the quinoline insoluble components to be suspended in the fluid pitch.

Examples of suitable fluxing liquids are tetrahydrofuran, light aromatic gas oils, heavy aromatic gas oils, toluene and tetralin. In general, the amount of organic fluxing liquid employed will be in the range of about 0.5 to 3 parts by weight of the organic fluxing liquid per part by weight of pitch; the preferred weight ratio being in the range of 1:1 to 2:1.

Solid materials, which consist of all the quinoline insoluble components such as coke, catalyst, and other quinoline insolubles formed during the heat soaking step, are separated from the fluid pitch by sedimentation, centrifugation or filtration.

Following separation of the suspended solid material, the fluid pitch is treated with an anti-solvent to precipitate and flocculate that portion of the fluid pitch that is neomesophase and especially useful for conversion into carbon fibers. Solvent or solvent mixtures having a solubility parameter between 8.0 and 9.5, preferably between 8.7 to 9.2, at 25° C. are required. Illustrative examples are aromatic hydrocarbons such as benzene, toluene, and xylene as well as mixtures thereof with aliphatic hydrocarbons, such as toluene/heptane mixtures. The preferred solvents are mixtures of solvents are toluene or toluene/heptane mixtures where the amount of toluene is at least 60 volume %.

As described by Greenwood, the anti-solvent will be employed in amounts sufficient to provide a solvent insoluble fraction, which is capable of being thermally converted to greater than 90% of an optically anisotropic material in less than 10 minutes. The ratio of the anti-solvent to pitch will generally be from about 5 ml to 150 ml of solvent per gram of pitch.

After precipitation of the neomesophase or mesophase fraction of the pitch, the precipitate can be recovered by sedimentation, centrifugation or filtration. The quinoline insolubles content has been lowered to less that about 0.1%. The precipitate is then dried in, for example, a rotary-vacuum oven, and for ease of handling may be extruded at elevated temperatures to form pellets.

Referring again to U.S. Pat. No. 4,277,324 (Greenwood), the disclosure in column 5, line 3, to column 7, line 8, is incorporated herein by reference.

SPINNING

Spinning is carried out by feeding the precipitated mesophase pitch fraction, generally in the form of pellets, into a screw extruder and through a spinneret to form essentially round or circular cross-section fibers, quenching the filaments in air, and collecting the filaments conventionally. The spinning apparatus may be of the conventional type, but for the present invention it can be advantageous to use the spinneret shown and described in U.S. Pat. No. 4,576,811 (Riggs et al.) See especially FIGS. 1 and 2 as well as Example 2 of Riggs et al. The former are described in column 2, line 50 to column 4, line 10; while the latter is found in column 4, line 49, to column 5, line 7. These disclosures are incorporated herein by reference.

The rate of spinning is generally 100 to 1000 meters/minute. In general, the spun fiber diameter will range from about 5 to 20 microns.

STABILIZATION

In the next processing step the as-spun or green fibers are subjected to stabilization or infusibilization. The method and apparatus of U.S. Pat. No. 4,576,810 (Redick) are employed. As known in the art, the as-spun fibers are collected in the usual manner on a spinning spool or bobbin. U.S. Pat. Nos. 4,351,816 and 4,527,754 illustrate such spools, which would be useful for this operation.

According to the process of this invention, and using Redick's method and apparatus, the as-spun or green fibers are oxidized directly on the spinning spool with air or a mixture of oxygen and an inert gas. In general, the amount of oxygen in the gaseous mixture will vary from about 1 to 21% by volume, the higher figure being reached when air is used.

The stabilization temperature may vary from 200° to 340° C. and the stabilization will generally take place over several hours. It will be understood that some minor experimentation may be necessary to determine optimum stabilization times and temperatures, and that shorter times are required at higher temperatures while longer times are required at lower temperatures.

Incorporated herein by reference is the disclosure in column 3, line 20, to column 4, line 34, of Redick in U.S. Pat. No. 4,576,810.

CARBONIZATION

The precarbonization and carbonization procedures are very important features of the present process. In general, precarbonization is carried out at a temperature of from about 400°-800° C., while primary carbonization is carried out at about 1000°-2000° C., preferably 1500°-1900° C. Precarbonization is carried out for 0.1 to 1 minute and carbonization for about 0.3 to 3 minutes. Longer treatment times would not be detrimental.

The thus treated carbon fibers may also be coated with an epoxy resin solution from an applicator taught in U.S. Pat. No. 4,624,102 (Bell, Jr.), utilizing as well the apparatus of this patent. Column 1, line 28 to column 2, line 45 of Bell, Jr. is incorporated herein by reference. This treatment reduces broken fibers on the surface of a carbon fiber yarn bundle. It will be understood, however, that this particular treatment may be omitted since it is not an essential feature of the present invention. Similarly, the apparatus and method of U.S. Pat. No. 4,689,947 (Winckler) may also be employed for reducing broken fibers on the surface of a carbon fiber yarn bundle.

Between the carbonization and the subsequent graphitization at temperatures of at least 2400° C., i.e. the so-called graphitization treatment, it may be advantageous for certain purposes to cool the fibers, wind the fibers on a spool or bobbin, and then unwind them. The exact significance of this procedure is not fully understood at this time, but it does appear to be of some benefit to ensure the obtention of high strength carbon fiber products.

The second carbonization or graphitization treatment is attained by subjecting the carbonized fiber to temperatures ranging from about 2400° to 3300° C., preferably from 2600° to 3000° C. The time period for achieving graphitization may vary over a wide range, as illustrated in the examples.

There is nothing critical in the type of graphitizing equipment employed in carrying out the second carbonization treatment at the higher temperatures. Various electric furnaces or ovens, such as the Tammann electric furnace or a Centorr Associates oven, under an inert atmosphere such as argon, or the like, may be employed. Thus, bobbins or spools or carbonized fibers may be piddled into circular packages and graphitized in a Centorr Associates oven under an argon atmosphere. The carbonized fibers, under zero tension, are next subjected to the elevated temperatures.

The graphite fiber products are cooled to ambient temperature and rewound onto bobbins or spools.

The graphite fibers have a number of outstanding characteristics that distinguish them from fibers heretofore disclosed or available commercially. More specifically, not only was Young's modulus greater than 100 Mpsi but tensile strength was greater than about 500 kpsi. Such a balanced ultra-high modulus and high tensile strength fiber made from mesophase pitch is unique insofar as it did not require the use of special feed material and special equipment and a special spinneret to obtain wavy cross-sectional, ellipsoidal, or multilobal fibers. Rather, the fibers of the invention have a substantially circular or round cross-sectional structure with average diameters of from about 5 to 20 microns.

Thus, the present fibers have improved elongation characteristics as a result of their balanced tensile properties. This means that yarns are easier to handle and can be passed over guides without breaking. It will be understood by those skilled in the art that improved elongation maximizes yields in the production process and in the formation of composite materials.

At the present time, the reasons why the carbon fibers of this invention have these excellent fiber properties are not entirely understood; it is believed, however, that the fiber properties stem from an unusual fiber fine structure, which has a high crystal order and contains few disrupting structural defects.

Carbon fiber products of the invention were tested and found to have a preferred crystal orientation angle of less than 6 degrees as measured by wide angle X-ray diffraction (WAXD). Crystal orientation angles of less than 6 degrees are characteristic of the present fibers and are highly desirable, since they are an indicium of ultra-high modulus. This measurement is performed conventionally, as described, for example, in U.S. Pat. No. 3,869,429 (Blades).

Small angle X-ray scattering (SAXS) is a measure of fiber voids and defects. SAXS intensity vs. scattering angle data were obtained in the equatorial direction using a Kratky camera X-ray system as described in U.S. Pat. No. 4,639,347 with the exception that a Philips-Norelco high intensity line focus X-ray tube with a 2.5 by 10 mm focal spot was used instead of the Siemens tube.

The specimens were prepared by winding the fiber on a rectangular frame with an opening sufficient to pass the X-ray beam. The fiber was wound with sufficient tension to yield a uniform thickness of essentially parallel fibers. In certain cases the fibers were too brittle to be wound on the frame; in these cases the fibers were cut to the appropriate length, arranged so that the filaments were parallel and attached to the frame with tape. Specimen thickness after winding was sufficient that transmission of $CuK_\alpha$ radiation approached $1/e=0.368$. This ensures that diffracted intensity will be near the maximum obtainable.

Each sample was scanned between 0.1° and 5° $2\theta$ scattering angle. Data were digitized for computer analysis, smoothed, and corrected for sample thickness and background by the procedures described in U.S. Pat. No. 4,639,347.

The slope in the Porod region was obtained from a linear least squares fit of the ln (intensity) versus ln(h) (where h is the scattering vector$=4 \sin \theta/\lambda$) plot in the 1° to 4° $2\theta$ region, where $\lambda$ is the $CuK_\alpha$ wave length. This slope correlates with tensile strength. SAXS slopes of greater than about $-2.1$ were measured with fibers of this invention. By way of contrast, Amoco's P-120 had a SAXS slope of less than $-2.2$.

Laser Raman spectroscopy also showed outstanding structure regularity. More particularly, the fibers of this invention have a far more uniform structure than lower modulus carbon fibers (ca. 30 Mpsi) or Amoco's P-120 in at least three respects:

(a) present fibers have the same, highly graphitic structure, from skin to core;

(b) the differences between fibers or along fibers are very small; and (c) there are no shifts due to residual stresses.

The laser Raman spectroscopy measurements were made in accordance with the following.

Fibers were embedded in epoxy resin, cut at an angle to the fiber axis and polished to provide an ellipitcal section with an aspect ratio of about ten. After ultrasonic cleaning in solvent to remove potential contaminants, laser Raman dynamic scattering (1420 to 1680 cm−1) from several areas of the section was determined by a "Ramanor U-100" microprobe with an Argon-Ion laser filtered to provide 514.532 nm light for illumination. Long axis of the section was aligned parallel to the laser polarization; a lens system was used to focus the laser to a 2–3 micron diameter spot on the section. Great care was taken to assure that the spot size and position were constant during data acquisition and that incident light intensity was insufficient to damage the specimen.

The invention will be more fully understood by reference to the following embodiments, which, however, are not intended to be limitative.

EXAMPLE I

A commercially available petroleum pitch (Ashland 240) was vacuum stripped and then heated at a temperature of 177° C. and placed in a reactor, a vacuum of about 29 inches Hg was drawn, the pitch heated to 363° C., and held at that temperature until the toluene insolubles content was about 20%. The total time was about 13 hours.

Thereafter, the vacuum was broken with nitrogen, the pitch heated to 391° C., held at that temperature for about 1 hour, cooled to 363° C., sampled to confirm a toluene insolubles content of 24–26%, and then cooled to room temperature.

The pitch so obtained was pulverized, fluxed with toluene (1:1 weight ratio of solvent to pitch, by weight) by heating to the reflux temperature for about one hour. The solution was passed through a 5 micron filter, and admixed with sufficient toluene/heptane (83:17) ("anti-solvent") to provide (a) an 85:15 by volume toluene/heptane mixture and (b) an 8:1 mixed solvent/pitch ratio, by volume/weight.

After refluxing for 1 hour, the mixture was cooled to ambient temperature and the precipitated solids were isolated by centrifugation. The cake was washed with additional anti-solvent and then dried in a rotary-vacuum oven. Several such batches were blended, melted at about 400° C., passed through a 2 micron filter, and extruded into pellets. At this point, the pitch pellets have a quinoline insolubles (ASTM 75° C.) of less than 0.1% by weight and are 100% mesophase, as determined by the polarized light microscopy method.

The pellets were remelted when fed to a screw extruder with an exit temperature of 350° C., spun at about 360° C. through a 4 inch diameter/480 hole spinneret. The holes are round and arrayed in 5 concentric rings (96 holes per ring) located in the outer ½ inch of the spinneret face. Each hole has a counterbore diameter of 0.055 inch, a capillary diameter of 200 microns, a capillary length of 800 microns (L/D equals 4), and an entrance angle of 80/60 degrees, as defined in Riggs et al. U.S. Pat. No. 4,576,811 (See particularly, Example 2).

The spinneret is externally heated to about 360° C., and the spinning cell comprises an outer quench tube about 6 inches in diameter, 5 feed long, with top 6 inches screened to permit entry of quench air at room temperature. Aspiration is provided by a tapered (3 to 2½ inches) center column that is 4 inches long. Water is supplied to the air-cooled as-spun filaments or green fibers, which are wound at 550 yards per minute onto a spool disclosed in U.S. Pat. No. 4,527,754 (Flynn).

Several spool packages, each containing about 1 pound of yarn, were batch stabilized by heating in air. All were held for 30 minutes at 225° C., heated to 255° C. over 30 minutes, then held at 255° C. for at least 2 hours. Most spools were treated for 3 hours.

Carbonization was carried out by combining the yarn from 6 stabilized packages mounted in a creel to form a 2880 filament tow (nominally "3K") forwarded at 4 feet/minute under the tension of its own weight (about 150 grams) through a 3 foot long precarbonization oven at 600°-800° C., then through a 19 foot long, carbon-resistance oven having a 1000°-1200° C. entrance zone, a 1600° C. carbonization zone, and an exiting 1000°-1200° C. zone. The fibers were at carbonization temperatures for about 1 minute.

The carbonized yarn was next passed through a 19 foot long chamber containing dried, room temperature air admixed with 0.098% (980 ppm) of ozone supplied at a rate of 1 cfm. The yarns are overlayed with a 1% solution of epoxy resin (CMD-W55-5003, sold by the Celanese Corporation) in water, using the method and apparatus shown in U.S. Pat. No. 4,624,102 (Bell, Jr.). The thus treated yarns were dried at 350° C. for 4 minutes and then cleaned by passing the yarn through the guide described and illustrated in U.S. Pat. No. 4,689,947 (Winckler). At this point, a yarn from a representative spool had a tenacity of 370 kpsi and a modulus of about 30 Mpsi.

A group of 8 bobbins of these carbonized yarns were piddled into circular packages on graphite trays and graphitized in a Centorr Associates oven under an argon atmosphere. The yarns were not restrained (zero tension). Temperatures were increased to 1500° C. over an 85 minute period, then to 2800° C. over 60 minutes, and held for 20 minutes at 2800° to 2890° C.

Bobbins of graphitized yarn were wound from the piddled packages. Single fiber tensile strength was determined for each bobbin at a 1" gauge length following ASTM 3379. The average single fiber tensile strength for fibers on all 8 bobbins was 530 kpsi. The highest single bobbin average was 600 kpsi. Modulus of representative bobbins was determined ultra-sonically following the method described by Eby (J. J. Smith, H. Jiang and R. K. Eby Polymer Communications Vol 28, p. 14, 1987). The average fiber modulus was greater than 125 Mpsi; average modulus of the highest single bobbin was 135 Mpsi. Based on scanning electron micrograph (SEM) of fracture surfaces, these fibers appears to exhibit a unique microstructure, generally "radial" in character, with high frequency, low amplitude kinking evident in most lamella, with occasional high amplitude kinks that are in registry with adjacent lamallae. No sheath-core character is discernible; the lamallae extend from the center of the fiber to its periphery.

The above data reveal the production of high tensile strength as well as ultra-high modulus carbon fibers. That the carbon fibers of this invention have excellent tensile properties in comparison with available commercial fibers becomes readily apparent from reviewing Amoco's Technical Bulletin F-7010 (Rev. 2/1/87). The latter's commercial fiber P 120 has a typical fiber tensile strength of 325 kpsi at 120 Mpsi modulus. Furthermore, the instant carbon fibers also have a higher break elongation than P 120 fibers; improved elongation means that yarns are easier to handle and can be passed over guides without breaking. As previously noted, this is an important characteristic both for maximizing yields in the production process and in forming reinforced composite materials. Thus, a representative fiber sample was tested by hand pulling the yarn over cylinders of various diameters; it showed no broken fibers at a 0.19 inch radius of curvature. In contrast, Amoco's P 120 showed some breaks at 0.25 inch radius and many breaks at 0.19 inch radius.

A representative inventive fiber also has a preferred crystal orientation angle of 5 degrees as measured by wide angle X-ray diffraction (WAXD). Small angle X-ray scattering (SAXS) ln (intensity)/ln (scattering vector) slope was measured for 6 of the 8 samples. Average value was −1.98 (−1.88 to −2.05 range). P-120, by contrast, has a slope of less than −2.3.

Laser Raman spectroscopy showed high structure regularity. Thus, for example, carbon fibers made similarly to those of Example 1 showed a sharp graphite peak at the 1584 wave number. The peak's sharpness and location shows that there are few residual strains in the fiber; residual strains reduce strength. No peaks corresponding to disordered carbon were observed. Analysis of these spectra also permit determination of certain uniformity parameters, where the larger number indicates the greater uniformity.

| | THIS INVENTION | | AMOCO |
|---|---|---|---|
| | CARBONIZED FIBER | GRAPHITIZED FIBER | P-120 (GRAPHITIZED) |
| UNIFORMITY OF: | | | |
| PEAK WIDTH | 1.7 | 5.0 | 1.2 |
| FREQUENCY | 0.5 | 7.9 | 0.5 |

These data clearly indicate that the fibers of this invention are highly uniform, i.e., structurally homogeneous, and that such uniformity of structure appears to be achieved during the graphitization step.

EXAMPLE II

This example describes the results of a production run and illustrates the consistently good results obtained.

Several hundred packages of yarn were prepared following the methods described in Example I except that a proprietary silicone oil finish (DP-9503-1; Takimoto Oil & Fat Co.) was used instead of water. Fibers were prepared from a blend of several batches of heat-soaked pitch prepared from a refinery decant oil residue. Minor modifications in solvent ratios were needed to obtain the desired pitch melting point. Minor modifications were made in stabilization to obtain optimum carbonized strength. Yarn was wound onto spools after the primary carbonization described in Example I, except that highest temperature was 1530° C. and the fibers were treated with neither ozone nor epoxy finish. Carbonized yarns were piddled into packages and batch graphitized as described in Example I. Sixty representative packages were tensile tested (single filament) as 1"

gauge length following ASTM D 3379. Average tenacity of all 60 packages was 549 kpsi, average modulus exceeded 130 Mpsi. 95% of the 60 packages had tenacities above 500 kpsi.

EXAMPLE III

This example illustrates a second production run in which fibers were graphitized in a continuous rather than a batch operation. Fiber production was the same as Example II up to wind-up after primary carbonization. Several hundred spools were prepared by graphitizing continuously in the oven system described in Example I such that residence time at the highest temperature (2700° C.) was about 1 minute. Thirty two representative spools were tested as in Example II. Single fiber tensile strength averaged 511 kpsi; averaged modulus exceeded 120 Mpsi. Tensile strength of 69% of the items was above 500 kpsi. Properties though excellent, were somewhat lower than Example II indicating that the higher graphitization temperature and/or longer times are beneficial.

EXAMPLE IV

Composite unibars were prepared following the general method of Chang U.S. Pat. No. 4,681,911, Example I, using as matrix polymer the composition number 2 from Table 1 (both column 4). Reinforcing fibers were prepared as in Example I, supra, or purchased (Amoco P-120). The test specimens were ½" wide, 6" long and ca. 100 mils thick and each contained ca. 58 volume per cent of reinforcing fiber. Testing was conducted in according to the ASTM tests referenced in U.S. Pat. No. 4,681,911 and the following results were obtained:

| Reinforcing Fiber | Flex Modulus (Mpsi) | Flex Strength (kpsi) | SBSS (kpsi) |
|---|---|---|---|
| This invention | 55 | 77 | 4.3 |
| Amoco P-120 | 40 | 53 | 3.8 |

Similar short beam shear strengths (SBSS) are indicative of surface treatments (for adhesion) which are comparable. Accordingly, about 40% improved composite flex modulus and strength for the instant fibers further and dramatically illustrate their utility in the applications (i.e., matrix reinforcement) for which they are intended. Indeed, when the same pair of fibers were compared in metal matrices, i.e., in magnesium alloy wires and strands, similar improvements also were observed.

What is claimed is:

1. A composite comprising a matrix reinforced with substantially round or circular cross-sectional, pitch-derived carbon fibers with balanced tensile strength and modulus characteristics having a crystal orientation angle of less than 6 degrees, a small angle x-ray scattering (SAXS) slope between about −1.8 and −2.1, an ultra-high modulus greater than 100 Mpsi, and a fiber tensile strength of at least about 500 kpsi.

2. The composite of claim 1 wherein the matrix is a polymer.

3. The composite of claim 1 wherein the matrix is a metal.

* * * * *